US006925653B1

(12) United States Patent
King

(10) Patent No.: US 6,925,653 B1
(45) Date of Patent: Aug. 9, 2005

(54) FINGER PROTECTOR FOR USING A HAMMER

(76) Inventor: Martin A. King, 2121 Silver Lake Ave., Los Angeles, CA (US) 90039

( * ) Notice: Subject to any disclaimer, the term of this patent is extended or adjusted under 35 U.S.C. 154(b) by 0 days.

(21) Appl. No.: 10/877,427

(22) Filed: Jun. 28, 2004

(51) Int. Cl.[7] ..... A41D 19/00
(52) U.S. Cl. ..... 2/21; 2/21; 2/163
(58) Field of Search ..... 2/21, 163, 161.6, 2/2.5, 16; 602/22

(56) References Cited

U.S. PATENT DOCUMENTS

| | | | | |
|---|---|---|---|---|
| 4,796,302 A | | 1/1989 | Davis | |
| D335,938 S | | 5/1993 | Kam | |
| 5,232,436 A | * | 8/1993 | Janevski | 602/22 |
| 5,662,594 A | * | 9/1997 | Rosenblatt | 602/16 |
| 5,819,312 A | | 10/1998 | Snyder | |
| 6,684,406 B2 | * | 2/2004 | Fowler | 2/16 |

* cited by examiner

*Primary Examiner*—John J. Calvert
*Assistant Examiner*—Andrew W. Sutton

(57) ABSTRACT

A finger protector includes a first plate having a shape for covering a knuckle of a thumb and an area between the thumb knuckle and a top side of a hand. A second plate has a shape for abutted against the thumb knuckle. The first plate is rotationally coupled to the second plate. A thumb covering has a size and shape adapted for covering an upper surface of the thumb. A proximal end of the thumb covering is rotationally attached to the second plate. A finger covering has a size and shape adapted for covering an upper surface of an index finger. The finger covering has a first end rotationally attached to the first plate. A plurality of couplers couples the finger covering to the index finger and the thumb covering to the thumb so that the thumb and the index finger are protected from a hammer.

14 Claims, 4 Drawing Sheets

FINGER PROTECTOR FOR USING A HAMMER

BACKGROUND OF THE INVENTION

1. Field of the Invention

The present invention relates to finger protecting devices and more particularly pertains to a new finger protecting device for protecting the sides and upper surface of a finger and a thumb of a person who is using a hammer.

2. Description of the Prior Art

The use of finger protecting devices is known in the prior art. U.S. Pat. No. 5,819,312 describes a glove device for protecting a hand from impact forces. This glove includes reinforcing material to help lessen the transfer of force to the hand. Another type of finger protecting device is U.S. Pat. No. 4,796,302 which includes a pair of finger sleeves into which a thumb and index finger may be positioned. The sleeves are made of a resilient material to prevent damage to the fingers. However, these do not provide adequate gripping and finger motility as the sleeves are attached together and they prevent direct contact with a nail. Another sleeve for protecting fingers is found in U.S. Pat. Des. No. 335,938.

While these devices fulfill their respective, particular objectives and requirements, the need remains for a device that allows freedom of movement of the fingers while prevent impact damage to the fingers, particularly from the impact of a hammer. Additionally, such a device should allow a person to have contact, if they so choose, directly with the nails so that a better grip on the nail may be achieved.

SUMMARY OF THE INVENTION

The present invention meets the needs presented above by generally comprising a first plate that has a first edge, a second edge, a third edge, a fourth edge, an outer surface and an inner surface. The first and second edges are positioned opposite of each other. The first plate has a shape for removably covering a knuckle of a thumb and an area between the thumb knuckle and a top side of a hand when the thumb is extended downwardly from the hand. A second plate has an outer side and an inner side. The inner side has a shape for being selectively abutted against the thumb knuckle. The first plate is rotationally coupled to the second plate. A thumb covering has a size and shape adapted for is removably positioned on an upper surface of the thumb so that the thumb covering extends along a length of and downwardly on either side of the thumb. The thumb covering has a proximal end and a distal end. The proximal end of the thumb covering is rotationally attached to the second plate. A finger covering has a size and shape adapted for being removably positioned on an upper surface of an index finger so that the finger covering extends along the length of and downwardly on either side of the index finger. The finger covering has a first end and a second end. The first end is rotationally attached to the first plate. A plurality of couplers includes a first coupler attached to the thumb covering for selectively attaching the thumb covering to the thumb and a second coupler being attached to the finger covering for selectively attaching the finger covering to the index finger. Each of the first plate, second plate, finger covering and thumb covering comprises a substantially rigid material. The thumb covering may be attached to the thumb and the finger covering attached to the index finger so that the upper surface and sides of the thumb and index finger are protected from a hammer.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
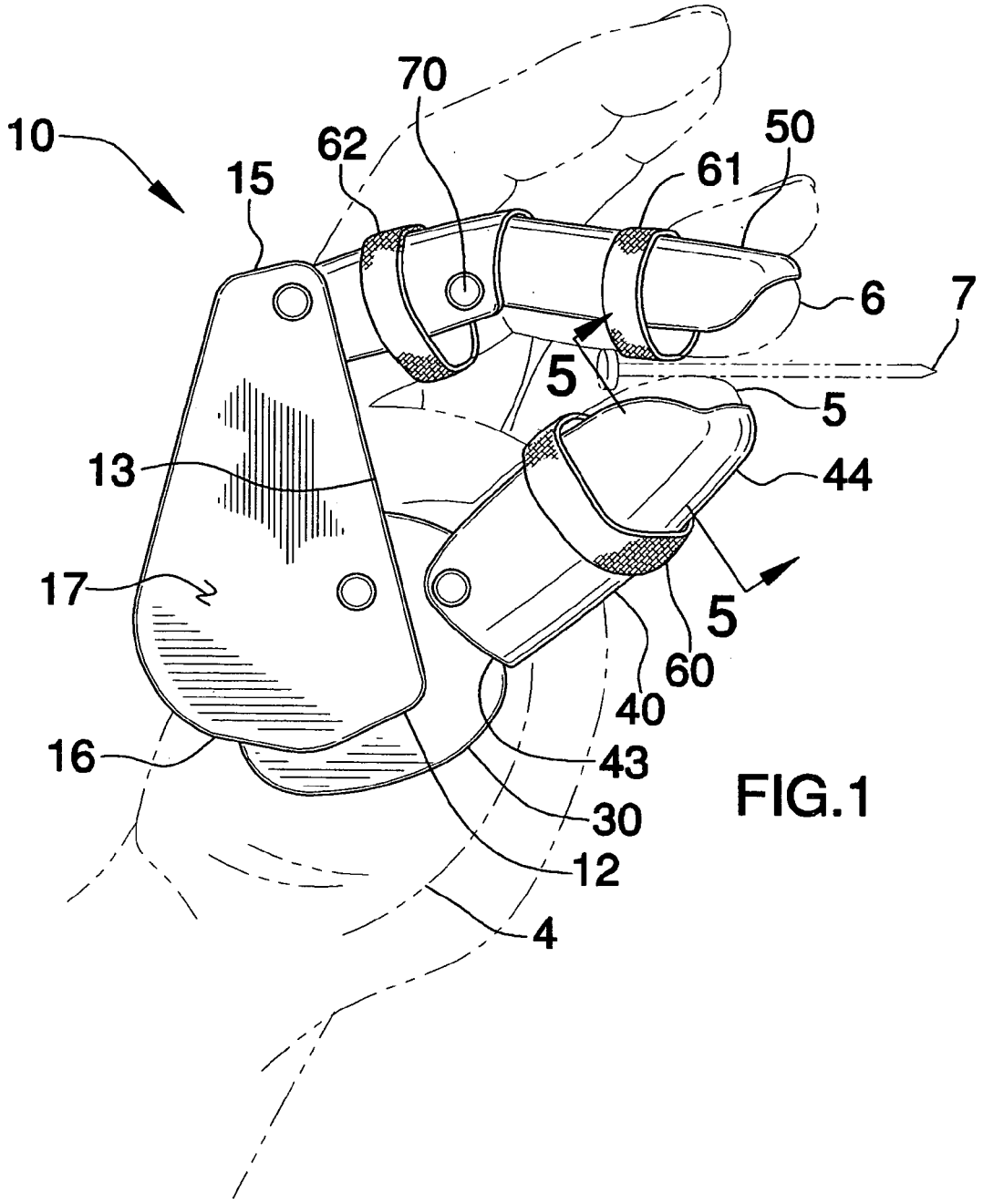
FIG. 1 is a perspective view of a finger protector for using a hammer according to the present invention.
Figure 2:
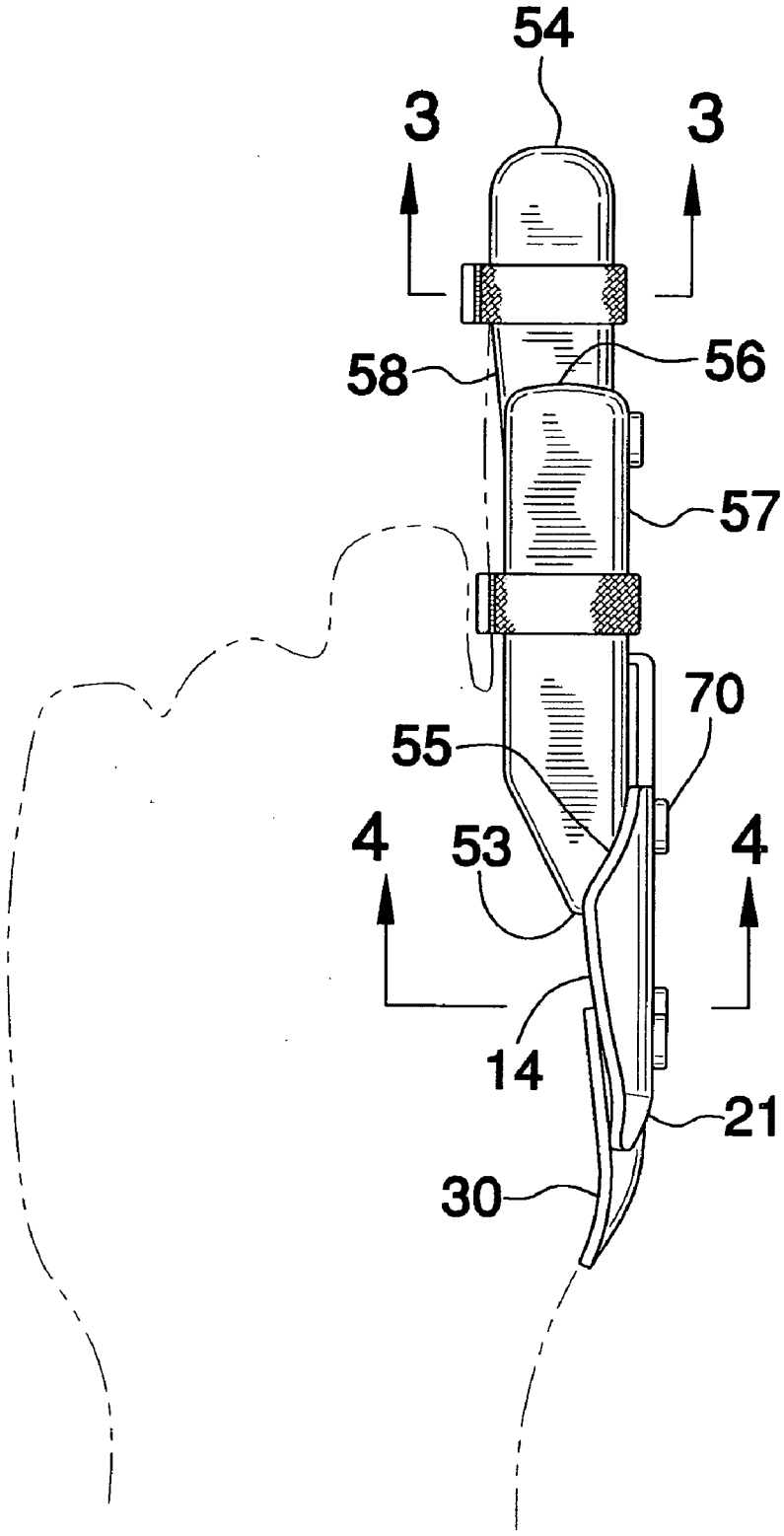
FIG. 2 is a top view of the present invention.

With reference now to the drawings, and in particular to FIGS. 1 through 5 thereof, a new finger protecting device embodying the principles and concepts of the present invention and generally designated by the reference numeral 10 will be described.

As best illustrated in FIGS. 1 through 5, the finger protector 10 for using a hammer generally comprises a first plate 12 that has a first edge 13, a second edge 14, a third edge 15, a fourth edge 16, an outer surface 17 and an inner surface 18. The first 13 and second 14 edges are positioned opposite of each other and it is preferred that junctures between the edges 13–16 are rounded. The first plate 12 has a shape for removably covering a knuckle of a thumb 5 and an area between the thumb knuckle and a top side of the hand 4 when the thumb 5 is extended downwardly from the hand 4. This is a generally quadrilateral shaped area wherein the first edge 13 extends from the thumb knuckle to an index knuckle, the third edge 15 extends from the side of the index knuckle to a top side of the hand 4, the second edge 14 extends along the top side of the hand 4 and the fourth edge 16 extends back to the thumb knuckle. The third edge 15 has a shorter length than the fourth edge 16. The first plate 12 has a first bend 19 therein positioned nearer the second edge 14 than the first edge 13 that extends between the third 15 and fourth 16 edges. The first bend 19 forms an angle generally between 90 degrees and 150 degrees in the inner surface 18. The first plate 12 has a second bend 20 therein positioned nearer the first edge 13 than the second edge 14 that extends between the third 15 and fourth 16 edges. The second bend 20 forms an angle generally between 120 degrees and 180 degrees in the inner surface 18. The first plate 12 has a third bend 21 therein extending between the first 13 and second 14 edges and is positioned generally adjacent to the fourth edge 16. The third bend 21 forms an angle generally between 140 and 170 degrees in the inner surface 18. The first 19, second 20 and third 21 bends contour the first plate 12 to the hand 4 for a comfortable fit.

A second plate 30 has an outer side 31 and an inner side 32. The inner side 32 is generally concave and has a shape for being selectively abutted against the thumb knuckle. The first plate 12 is rotationally coupled to the second plate 30 so that the inner surface 18 abuts the outer side 31 and a juncture of the first 13 and fourth edges 16 is generally centrally located on the second plate 30.

A thumb covering 40 has a size and shape adapted for is removably positioned on an upper surface of the thumb 5 so that the thumb covering 40 extends along a length of and downwardly on either side of the thumb 40. This is done with a central plate 41 and a pair of lateral plates 42, which form a generally U-shaped cross-section. The thumb covering 40 has a proximal end 43 and a distal end 44. The proximal end 43 of the thumb covering 40 is rotationally attached to the outer side 17 of the second plate 30 so that the thumb covering 40 may be extended along the thumb 5 when the second plate 30 is abutted against the thumb knuckle. The distal end 44 has a lip 45 attached thereto that may be selectively positionable over an end of the thumb 5.

Figure 3:
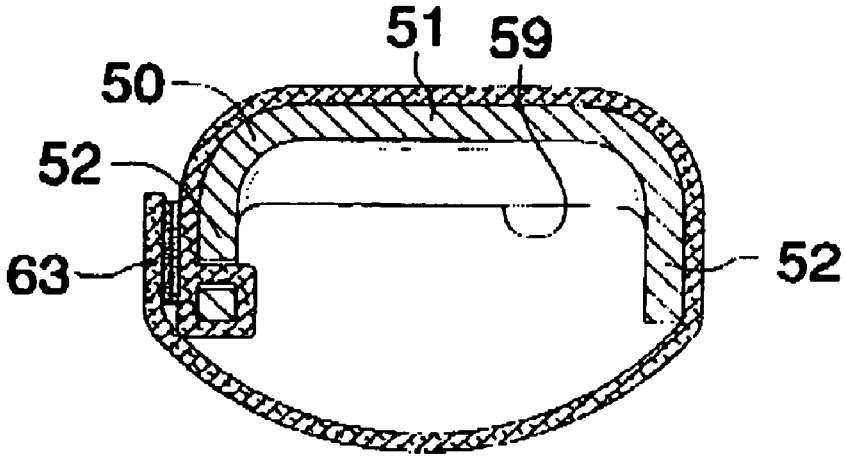
FIG. 3 is a cross-sectional view taken along line 3—3 of FIG. 2 of the present invention.
Figure 4:
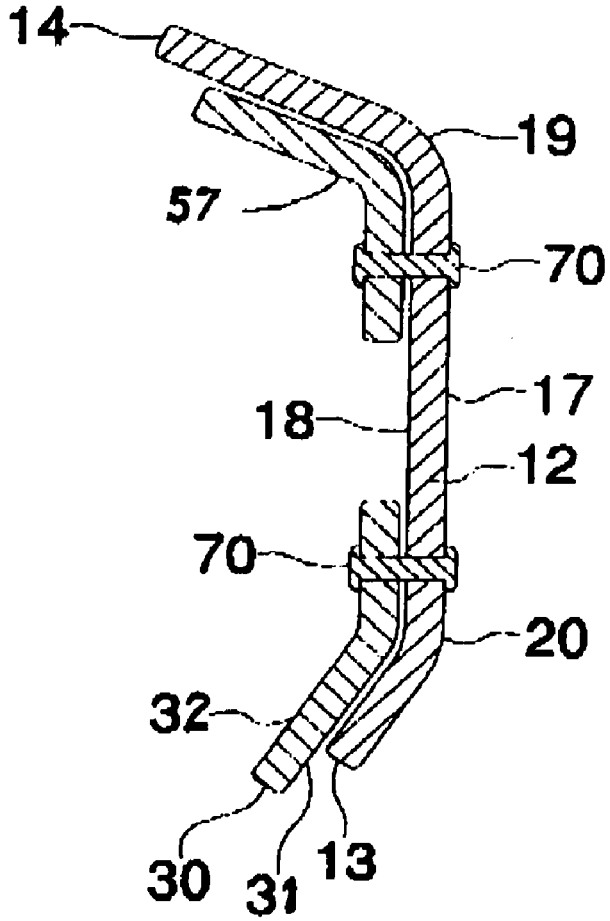
FIG. 4 is a cross-sectional view taken along line 4—4 of FIG. 2 of the present invention.
Figure 5:
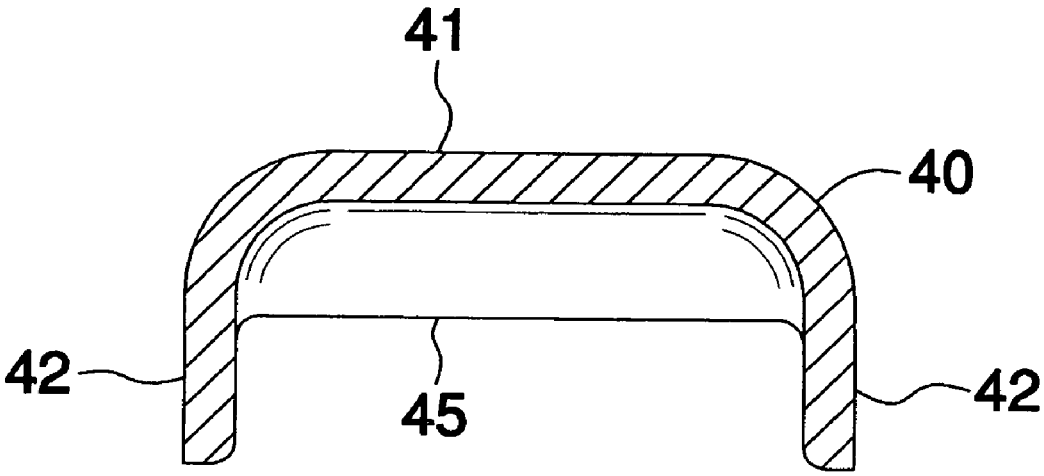
FIG. 5 is a cross-sectional view taken along line 5—5 of FIG. 1 of the present invention.

A finger covering 50 has a size and shape adapted for is removably positioned on an upper surface of an index finger 6 so that the finger covering 50 extends along the length of and downwardly on either side of the index finger 6. This is done with a central panel 51 a pair of lateral panels 52, which form a generally U-shaped cross-section as shown in FIG. 3. The finger covering 50 has a first end 53 and a second end 54. The first end 53 is rotationally attached to the inner surface 18 of the first plate 12 adjacent to a juncture of the first 13 and third 15 edges so that the finger covering 50 may be extended along the index finger 5 when the first plate 12 is abutted against a side of the hand 4. The third edge 15 may have a notch 55 therein to permit freedom of movement for the finger covering 50. The finger covering 50 has a break 56 therein generally positioned between the first 53 and second 54 ends so that a first portion 57 and a second portion 58 are defined. The first portion 57 is pivotally coupled to the second portion 58. The break 56 will generally be located on a middle knuckle of the index finger 6 when the finger covering 50 is placed on the index finger 6. A shoulder 59 is attached to the second end 54 of the finger covering 50. The shoulder 59 is selectively positionable over an end of the index finger 6.

A plurality of couplers is utilized for attaching the finger protector 10 to the index finger 6 and to the thumb 5. A first of the couplers 60 is attached to the thumb covering 40 for selectively attaching the thumb covering 40 to the thumb 5 and a second of the couplers 61 is attached to the finger covering 50 for selectively attaching the finger covering 50 to the index finger 6. The second covering 61 is positioned adjacent to the second end 54. A third coupler 62 may be utilized which is attached to the finger covering 50 adjacent to the first end 53 of the finger covering 50. The couplers 60–62 preferably include straps that may be formed into loops using a hook and loop fastening means 63.

Each of the first plate 12, second plate 30, finger covering 50 and thumb covering 40 comprises a substantially rigid material. This material may be composite graphite, a plastic or a metal material. A material should be selected which will not easily bend and will not break into shards. In particular, aluminum alloys are favored. Rivets 70 may be used for pivotally and rotationally coupling these elements together as described above. Additionally, a cushioning material, not shown, may be attached to the inner surfaces and sides of the fist 12 and second 30 plates as well as bottom sides of the finger 50 and thumb 40 coverings.

In use, a user of the protector 10 attaches the thumb covering 40 to their thumb 5 and the finger covering 50 to their finger 6 so that the top surfaces and sides of those digits are protected. While hammering, should the user strike the thumb 5 or index finger 6 instead of a nail 7, the coverings 40, 50 will offer protection from the impact. The finger 50 and thumb 40 coverings are open to allow a person the ability to easily grasp a nail 7 while still protecting themselves from the hammer.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A thumb and finger protecting device for removably positioning on a hand while using a hammer, said device comprising:

a first plate having a first edge, a second edge, a third edge, a fourth edge, an outer surface and an inner surface wherein said first and second edges are positioned opposite of each other, said first plate having a shape for removably covering a knuckle of a thumb and an area between the thumb knuckle and a top side of the hand when the thumb is extended downwardly from the hand, said first plate having a first bend therein positioned nearer said second edge than said first edge and extending between said third and fourth edges, said first bend forming an angle generally between 90 degrees and 150 degrees in said inner surface, said first plate having a second bend therein positioned nearer said first edge than said second edge and extending between said third and fourth edges, said second bend forming an angle generally between 120 degrees and 180 degrees in said inner surface, said first plate having a third bend therein extending between said first and second edges and being positioned generally adjacent to said fourth edge, said third edge having a shorter length than said fourth edge;

a second plate having an outer side and an inner side, said inner side having a shape for being selectively abutted against the thumb knuckle, said first plate being rotationally coupled to said second plate;

a thumb covering having a size and shape adapted for being removably positioned on an upper surface of the thumb so that said thumb covering extends along a length of and downwardly on either side of the thumb, said thumb covering having a proximal end and a distal end, said proximal end of said thumb covering being rotationally attached to said second plate;

a finger covering having a size and shape adapted for being removably positioned on an upper surface of an index finger so that said finger covering extends along the length of and downwardly on either side of the index finger, said finger covering having a first end and a second end, said first end being rotationally attached to said first plate;

a plurality of couplers, a first of said couplers being attached to said thumb covering for selectively attaching said thumb covering to the thumb, a second of said coupler being attached to said finger covering for selectively attaching said finger covering to the index finger;

each of said first plate, second plate, finger covering and thumb covering comprising a substantially rigid material; and wherein said thumb covering may be attached to the thumb and said finger covering attached to the index finger so that the upper surface and sides of the thumb and index finger are protected from a hammer.

2. The device according to claim 1, wherein said inner surface of said first plate abuts .said outer side of said second plate and a juncture of said first and fourth edges is generally centrally located on said second plate.

3. The device according to claim 1, wherein said thumb covering is rotationally attached to said outer side of said second plate.

4. The device according to claim 1, wherein said distal end has a lip being attached thereto, said lip being selectively positionable over an end of the thumb.

5. The device according to claim 2, wherein said first end of said finger covering is rotationally attached to said inner surface of said first plate adjacent to a juncture of said first and third edges.

6. The device according to claim 5, wherein said finger covering has a break therein generally positioned between said first and second ends so that a first portion and a second portion are defined, said first portion being pivotally coupled to said second portion.

7. The device according to claim 6, a shoulder being attached to said second end of said finger covering, said shoulder being selectively positionable over an end of the index finger.

8. The device according to claim 7, wherein said distal end has a lip being attached thereto, said lip being selectively positionable over an end of the thumb.

9. The device according to claim 1, wherein said first end of said finger covering is rotationally attached to said inner surface of said first plate adjacent to a juncture of said first and third edges.

10. The device according to claim 9, wherein said finger covering has a break therein generally positioned between said first and second ends so that a first portion and a second portion are defined, said first portion being pivotally coupled to said second portion.

11. The device according to claim 10, a shoulder being attached to said second end of said finger covering, said shoulder being selectively positionable over an end of the index finger.

12. The device according to claim 9, wherein said second coupling is positioned adjacent to said second end, a third coupler being attached to said finger covering adjacent to said first end of said finger covering.

13. The device according to claim 6, wherein said second covering is positioned adjacent to said second end, a third coupler being attached to said finger covering adjacent to said first end of said finger covering.

14. A thumb and finger protecting device for removably positioning on a hand while using a hammer, said device comprising:

a first plate having a first edge, a second edge, a third edge, a fourth edge, an outer surface and an inner surface wherein said first and second edges are positioned opposite of each other, said first plate having a shape for removably covering a knuckle of a thumb and an area between the thumb knuckle and a top side of the hand when the thumb is extended downwardly from the hand, said first plate having a first bend therein positioned nearer said second edge than said first edge and extending between said third and fourth edges, said first bend forming an angle generally between 90 degrees and 150 degrees in said inner surface, said first plate having a second bend therein positioned nearer said first edge than said second edge and extending, between said third and fourth edges, said second bend forming an angle generally between 120 degrees and 180 degrees in said inner surface, said first plate having a third bend therein extending between said first and second edges and being positioned generally adjacent to said fourth edge, said third edge having a shorter length than said fourth edge;

a second plate having an outer side and an inner side, said inner side being generally concave and having a shape for being selectively abutted against he thumb knuckle, said first plate being rotationally coupled to said second plate so that said inner surface abuts said outer side and a juncture of said first and fourth edges is generally centrally located on said second plate;

a thumb covering having a size and shape adapted for being removably positioned on an upper surface of the thumb so that said thumb covering extends along a length of and downwardly on either side of the thumb, said thumb covering having a proximal end and a distal end, said proximal end of said thumb covering being rotationally attached to said outer side of said second plate such that said thumb covering may be extended along the thumb when said second plate is abutted against the thumb knuckle, said distal end having a lip being attached thereto, said lip being selectively positionable over an end of the thumb;

a finger covering having a size and shape adapted for being removably positioned on an upper surface of an index finger so that said finger covering extends along the length of and downwardly on either side of the index finger, said finger covering having a first end and a second end, said first end being rotationally attached to said inner surface of said first plate adjacent to a juncture of said first and third edges so that said finger covering may be extended along the index finger when said first plate is abutted against a side of the hand, said finger covering having a break therein generally positioned between said first and second ends so that a first portion and a second portion are defined, said first portion being pivotally coupled to said second portion, a shoulder being attached to said second end of said finger covering, said shoulder being selectively positionable over an end of the index finger;

a plurality of couplers, a first of said couplers being attached to said thumb covering for selectively attaching said thumb covering to the thumb, a second of said coupler being attached to said finger covering for selectively attaching said finger covering to the index finger, said second covering being positioned adjacent to said second end, a third coupler being attached to said finger covering adjacent to said first end of said finger covering;

each of said first plate, second plate, finger covering and thumb covering comprising a substantially rigid material; and wherein said thumb covering may be attached to the thumb and said finger covering attached to the index finger so that the upper surface and sides of the thumb and index finger are protected from a hammer.

* * * * *